US008805250B2

(12) United States Patent
Takami et al.

(10) Patent No.: US 8,805,250 B2
(45) Date of Patent: Aug. 12, 2014

(54) BLADE PRESSING MEMBER AND DEVELOPER CARTRIDGE

(71) Applicants: Takeshi Takami, Inazawa (JP); Ryuya Yamazaki, Nagoya (JP); Nao Itabashi, Nagoya (JP)

(72) Inventors: Takeshi Takami, Inazawa (JP); Ryuya Yamazaki, Nagoya (JP); Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 76 days.

(21) Appl. No.: 13/628,087

(22) Filed: Sep. 27, 2012

(65) Prior Publication Data

US 2013/0078007 A1 Mar. 28, 2013

(30) Foreign Application Priority Data

Sep. 28, 2011 (JP) ..... 2011-212985

(51) Int. Cl.
*G03G 15/08* (2006.01)
*G03G 21/18* (2006.01)

(52) U.S. Cl.
CPC ..... *G03G 15/0812* (2013.01); *G03G 21/181* (2013.01)
USPC ..... 399/284; 399/119

(58) Field of Classification Search
CPC ..... G03G 15/0812; G03G 21/181
USPC ..... 399/119, 284
See application file for complete search history.

(56) References Cited

U.S. PATENT DOCUMENTS 7,519,308 B2 * 4/2009 Bracken et al. ..... 399/99

FOREIGN PATENT DOCUMENTS

| | | |
|---|---|---|
| JP | H11-161011 A | 6/1999 |
| JP | 2004-102142 A | 4/2004 |
| JP | 2004-133261 A | 4/2004 |
| JP | 2011-069953 | 4/2011 |

OTHER PUBLICATIONS

First Office Action issued in corresponding Chinese Application No. 201210362804.7 mailed Apr. 3, 2014.

* cited by examiner

*Primary Examiner* — David Gray
*Assistant Examiner* — Michael Harrison
(74) *Attorney, Agent, or Firm* — Banner & Witcoff, Ltd.

(57) ABSTRACT

A developer cartridge includes a casing, a developing roller, a blade, a first blade pressing member and a second blade pressing member. The casing is configured to store developer therein. The developing roller is rotatably supported by the casing. The blade has a first end portion and a second end portion opposite to the first end portion. The first end portion is supported by the casing. The blade is configured to regulate the developer carried on a peripheral surface of the developing roller to a predetermined thickness at the second end portion. The first blade pressing member is configured to press the first end portion of the blade. The second blade pressing member is configured to be attached to and removed from the casing. The second blade pressing member includes a pressing portion configured to press the second end portion of the blade toward the developing roller.

19 Claims, 7 Drawing Sheets

BLADE PRESSING MEMBER AND DEVELOPER CARTRIDGE

CROSS REFERENCE TO RELATED APPLICATION

This application claims priority from Japanese Patent Application No. 2011-212985, filed on Sep. 28, 2011, the content of which is incorporated herein by reference in its entirety.

TECHNICAL FIELD

Aspects of the disclosure relate to a blade pressing member to be attached to a developer cartridge for use in an image forming apparatus, e.g., a laser printer, and a developer cartridge including the blade pressing member.

BACKGROUND

A known developer cartridge to be attached to an electrophotographic printer includes a casing in which toner is stored, a developing roller configured to carry toner on a surface thereof, and a layer-thickness regulating member configured to regulate toner carried on the surface of the developing roller to a predetermined thickness.

In the developer cartridge, the casing has an opening from which the developing roller is exposed. Before shipment or transportation, a developing roller cover is attached to the developer cartridge to cover the developing roller exposed from the opening, and then the developer cartridge is packaged in a shipping carton.

In addition, the need to reduce the physical size of the developer cartridge has been recently demanded. Thus, a developer cartridge in which a layer-thickness regulating member is disposed so as to be exposed from a casing has been proposed.

However, when the developer cartridge packaged as described above accidentally drops during shipment, the developing roller may be deformed due to drop impacts, resulting in that a gap may be formed between the developing roller and the layer-thickness regulating member. In this case, toner may leak from the gap between the developing roller and the layer-thickness regulating member.

SUMMARY

Aspects of the disclosure may provide a blade pressing member configured to prevent leakage of toner during shipment or transportation of a developer cartridge, and a developer cartridge including the blade pressing member.

According to one aspect of the disclosure, a developer cartridge includes a casing configured to store developer therein, a developing roller rotatably supported by the casing, a blade, a first blade pressing member, and a second blade pressing member. The blade has a first end portion and a second end portion opposite to the first end portion. The first end portion is supported by the casing. The blade is configured to regulate the developer carried on a peripheral surface of the developing roller to a predetermined thickness at the second end portion. The first blade pressing member is configured to press the first end portion of the blade. The second blade pressing member is configured to be attached to and removed from the casing. The second blade pressing member includes a pressing portion configured to press the second end portion of the blade toward the developing roller.

With this structure, the first pressing member presses the first end portion of the blade and the pressing portion of the second pressing member presses the second end portion of the blade toward the developing roller. During transportation, e.g., shipment, even if the developer cartridge accidentally drops, the possibility of a gap formed between the developing roller and the blade can be reduced. Thus, the possibility that toner leaks from between the developing roller and the blade can be reduced.

Thus, the first blade pressing member and the second blade pressing member can reduce the possibility of toner leakage during shipment of the developer cartridge.

BRIEF DESCRIPTION OF THE DRAWINGS

Illustrative aspects of the disclosure will be described in detail with reference to the following figures in which like elements are labeled with like numbers and in which:

FIGS. 5A and 5B illustrate how the blade pressing member is attached to the developer cartridge shown in FIG. 1, wherein FIG. 5A illustrates the developer cartridge to which the blade pressing member is yet to be attached, and FIG. 5B illustrates the developer cartridge to which the blade pressing member is attached;

DETAILED DESCRIPTION

A first illustrative embodiment of the disclosure will be described in detail with reference to the accompanying drawings.

Figure 1:
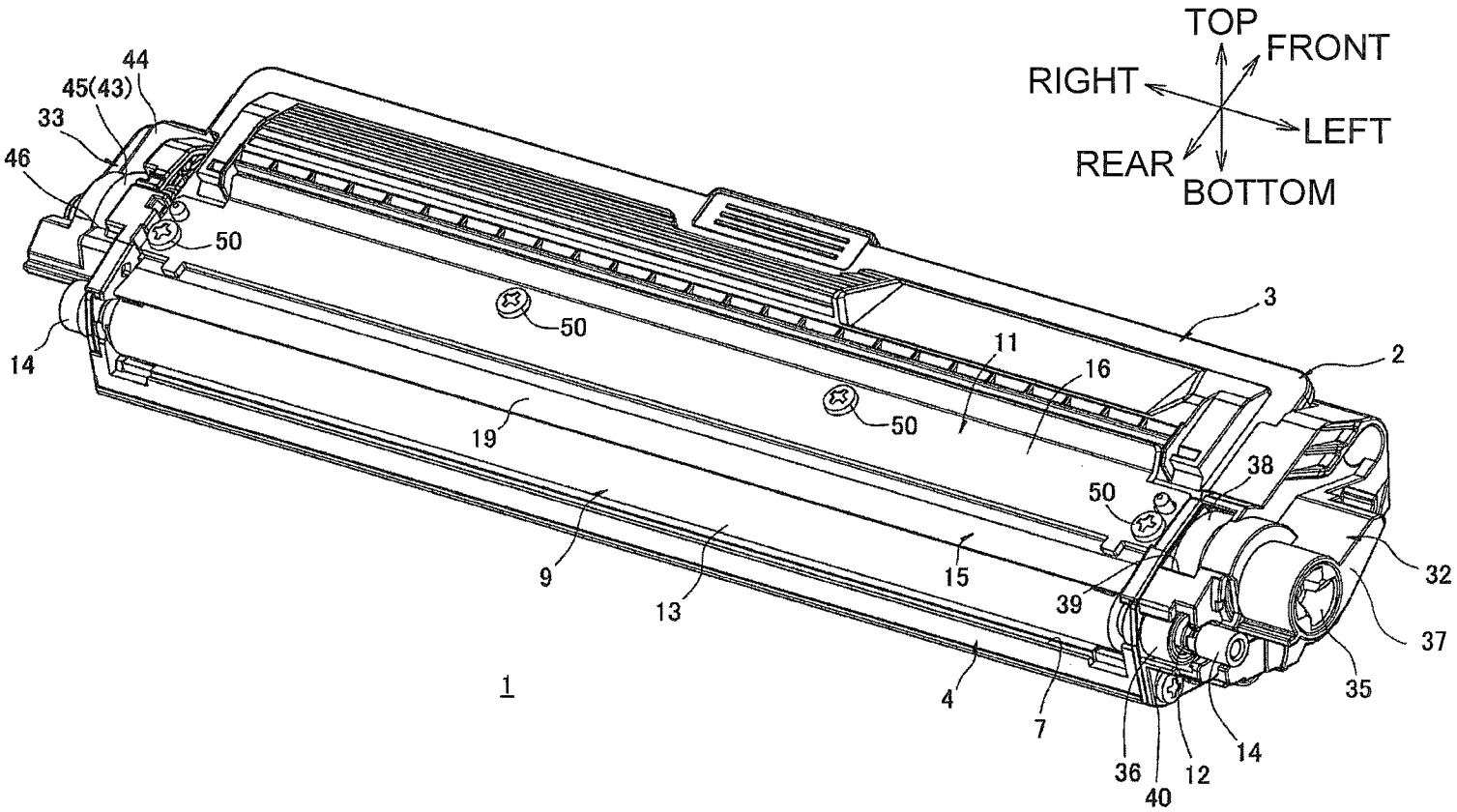
FIG. 1 is a perspective view of a developer cartridge without a blade pressing member.

In FIG. 1, a developer cartridge 1 is configured to be detachably attachable to an image forming apparatus (not shown), e.g., a laser printer. The image forming apparatus (not shown) may include a photosensitive member (not shown), e.g., a photosensitive drum, configured to carry an electrostatic latent image. The developer cartridge 1 is configured to supply developer onto the electrostatic latent image formed on the photosensitive member for developing the latent image. The image forming apparatus (not shown) is configured to transfer the electrostatic latent image developed with toner (or a toner image) from the photosensitive drum to a recording medium and then fix the toner image onto the recording medium.

As shown in FIG. 1, the developer cartridge 1 includes a developer frame 2 as an example of a casing.

The developer frame 2 is shaped like a rectangular box and has an opening 7 formed along a longitudinal direction of the developer frame 2.

In the following description, directions of the developer cartridge 1 are defined based on that the developer cartridge 1 is disposed horizontally. Specifically, the directions are defined by arrows in each drawing.

More specifically, a side of the developer cartridge 1 on which the opening 7 is formed is referred to as a rear or rear side, and a side of the developer cartridge 1 opposite from the opening 7 is referred to as a front or front side. The right or right side, and the left or left side are determined based on that the developer cartridge 1 is viewed from the front side.

Figure 5A:
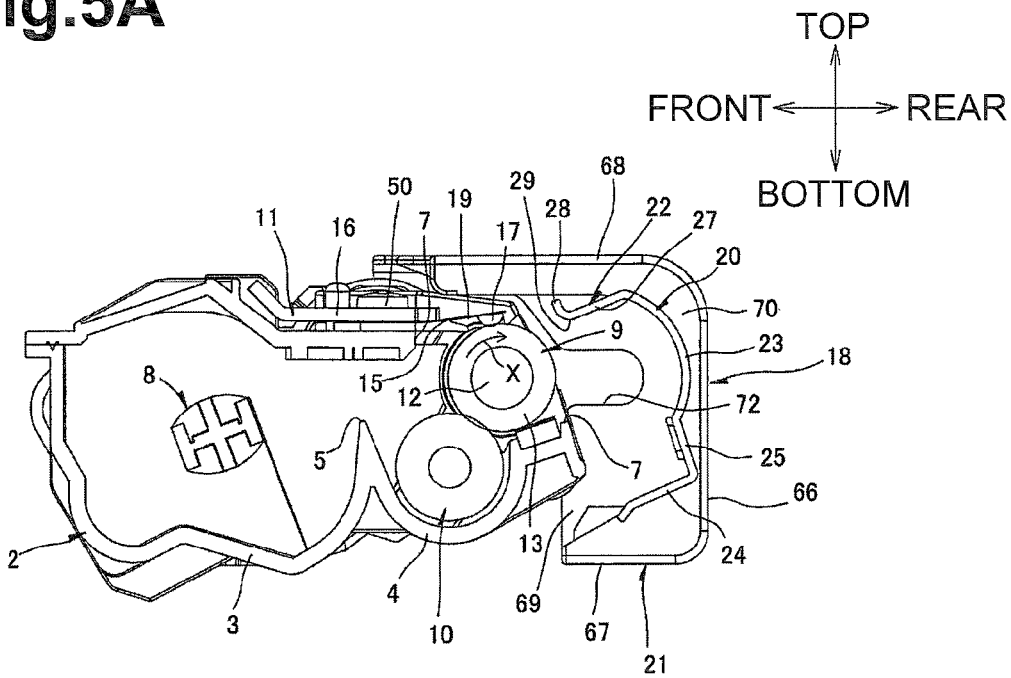

The developer frame 2 is shaped, in a plan view, like a rectangle elongated in the left-right direction. As shown in FIG. 5A, the front portion of the developer frame 2 is partitioned as a toner storing chamber 3, and the rear portion of the developer frame 2 is partitioned as a developing chamber 4. The internal space for the toner storing chamber 3 and the developing chamber 4 is communicated through a communication port 5 in the front-rear direction.

The toner storing chamber 3 stores toner as an example of a developer, and includes an agitator 8 disposed in a central portion of the toner storing chamber 3 in a side view.

The agitator 8 is rotatably supported by left and right sidewalls of the toner storing portion 3.

The opening 7 is formed at the rear end of the developing chamber 4 such that the opening 7 is released upward to the rear. The developing chamber 4 includes a developing roller 9, a supply roller 10, and a layer-thickness regulating member 11.

The developing roller 9 is disposed at the rear end of the developing chamber 4 such that its rear side and top side are exposed from the opening 7.

As shown in FIG. 1, the developing roller 9 includes a developing roller shaft 12 and a rubber roller 13 configured to carry toner on its peripheral surface.

The developing roller shaft 12 is shaped like a rod extending in the left-right direction, and its left and right end portions protrude outward from both sidewalls of the developing chamber 4 and are supported by both sidewalls of the developing chamber 4 such that the developing roller shaft 12 is rotatable.

The left and right end portions of the developing roller shaft 12 protruding from both sidewalls of the developing chamber 4 are covered with developing roller collars 14.

The developing roller collars 14 are shaped substantially cylindrically. The developing roller collars 14 are fitted around the left and right end portions of the developing roller shaft 12 so as to cover them.

The rubber roller 13 is disposed to cover the developing roller shaft 12 such that the left and right end portions of the developing roller shaft 12 are exposed.

As the developing roller shaft 12 is rotatably supported by both sidewalls of the developing chamber 4, the developing roller 9 is rotatably supported by the developer frame 2.

As shown in FIG. 5A, the developing roller 9 is driven to rotate in direction X indicated by an arrow (or counterclockwise in the right side view) at a contact portion where the developing roller 9 contacts a blade 15 during developing operation.

The supply roller 10 is disposed below and in front of the developing roller 9 in the developing chamber 4 such that a lower front side of the rubber roller 13 contacts an upper rear side of the supply roller 10.

The supply roller 10 is rotatably supported by both sidewalls of the developing chamber 4.

The layer-thickness regulating member 11 is disposed on an upper surface of an upper wall of the developer frame 2, and integrally includes the blade 15 and a reinforcing member 16 as an example of a first blade pressing member. The blade 15 is configured to regulate a layer thickness of toner carried on the peripheral surface of the rubber roller 13.

As shown in FIG. 1, the blade 15 has a shape of a rectangle elongated in the left-right direction, and is formed from a thin metal plate having elasticity.

As shown in FIG. 5A, a rear end portion of the blade 15 includes a regulating portion 17 disposed on a lower surface of the blade 15.

The regulating portion 17 is formed from an elastic resin, e.g., silicone resin, disposed along the left-right direction, and shaped like an arc protruding downward in a side view.

The reinforcing member 16 is made from a metal plate thicker than that for the blade 15, and is formed like a flat plate elongated in the left-right direction (FIG. 1).

The blade 15 and the reinforcing member 16 are fixed such that an upper surface of a front end portion of the blade 15 is bonded to a lower surface of a rear portion of the reinforcing member 16. Thus, as shown in FIG. 1, a rear end portion of the blade 15 (or an exposed portion 19) is exposed from the reinforcing member 16.

As shown in FIG. 5A, the reinforcing member 16 is disposed such that the reinforcing member 16 and the upper wall of the developer frame 2 sandwich the front end portion of the blade 15 therebetween. With this state, the layer-thickness regulating member 11 is fixed to the developer frame 2 using screws 50 as shown in FIG. 1.

Thus, the front end portion of the blade 15 is supported by the upper wall of the developer frame 2, and the exposed portion 19 is exposed from the developer frame 2.

The regulating portion 17 of the blade 15 contacts the rubber roller 13 from above. In other words, the blade 15 is disposed such that the rotation direction X of the developing roller 9 is the same direction as a direction pointing from the front end portion of the blade 15 to the rear end portion thereof (or the front-rear direction) at the contact portion between the rubber roller 13 and the regulating portion 17.

The developer cartridge 1 includes a drive unit 32 disposed on the left side of the developer frame 2 and a power supply unit 33 disposed on the right side of the developer frame 2.

The drive unit 32 includes a developing coupling 35 positioned substantially centrally on a left sidewall of the developer frame 2 in the front-rear direction, a developing gear 36 disposed on the developing roller shaft 12, a gear portion 38 and a drive-side gear cover 37 covering the developing coupling 35 and the developing gear 36 and the gear portion 38.

The drive-side gear cover 37 extends in the left-right direction and is shaped like a box opening rightward.

The drive-side gear cover 37 has a gear portion exposure hole 39 and a developing gear exposure hole 40, which are formed therethrough.

The gear portion exposure hole 39 is shaped like a rectangle in a plan view and formed in a central portion in the front-rear direction of an upper wall of the drive-side gear cover 37 such that an upper portion of the gear portion 38 of the developing coupling 35 is exposed.

The developing gear exposure hole 40 is shaped like a rectangle in a rear view and formed in a rear wall of the drive-side gear cover 37 such that a rear portion of the developing gear 36 is exposed.

The drive-side gear cover 37 is screwed to the left sidewall of the developer frame 2 such as to cover the developing coupling 35 and the developing gear 36.

The power supply unit 33 includes a sector gear 45, a new item detection gear 43 centered on a right sidewall of the developer frame 2 in the front-rear direction, and a power supply-side gear cover 44.

As shown in FIG. 1, the power supply-side gear cover 44 is shaped like a box extending in the left-right direction and opening leftward.

The power supply-side gear cover 44 has a sector gear exposure hole 46 formed therethrough.

The sector gear exposure hole 46 is shaped like a rectangle in a plan view and formed in a front side of an upper wall of the power supply-side gear cover 44 such that the sector gear 45 of the new item detection gear 43 is exposed.

The power supply-side gear cover 44 is screwed to the right sidewall of the developer frame 2 so as to cover the new item detection gear 43.

Figure 2:
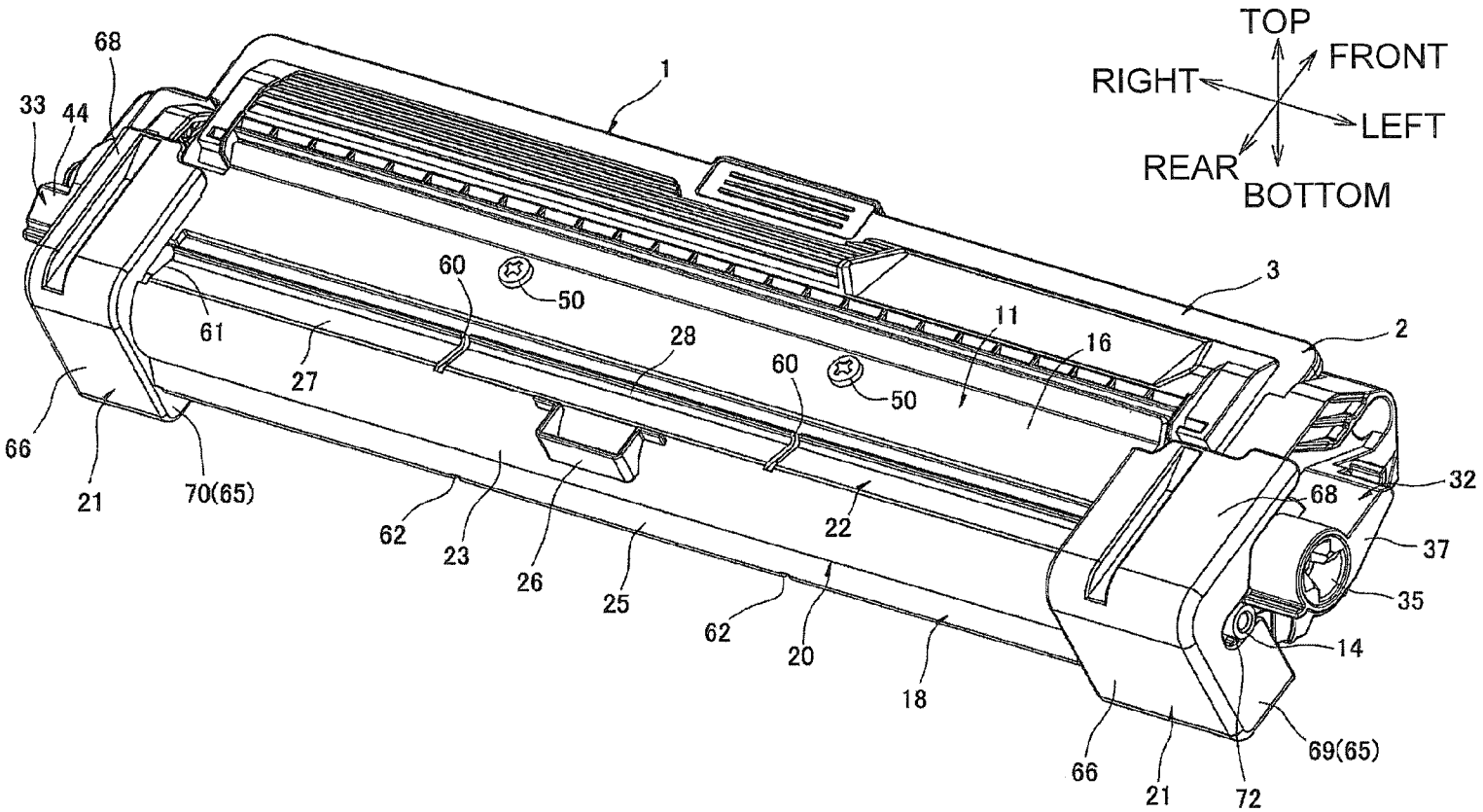
FIG. 2 is a perspective view of a developer cartridge according to a first illustrative embodiment of the disclosure.
Figure 6:
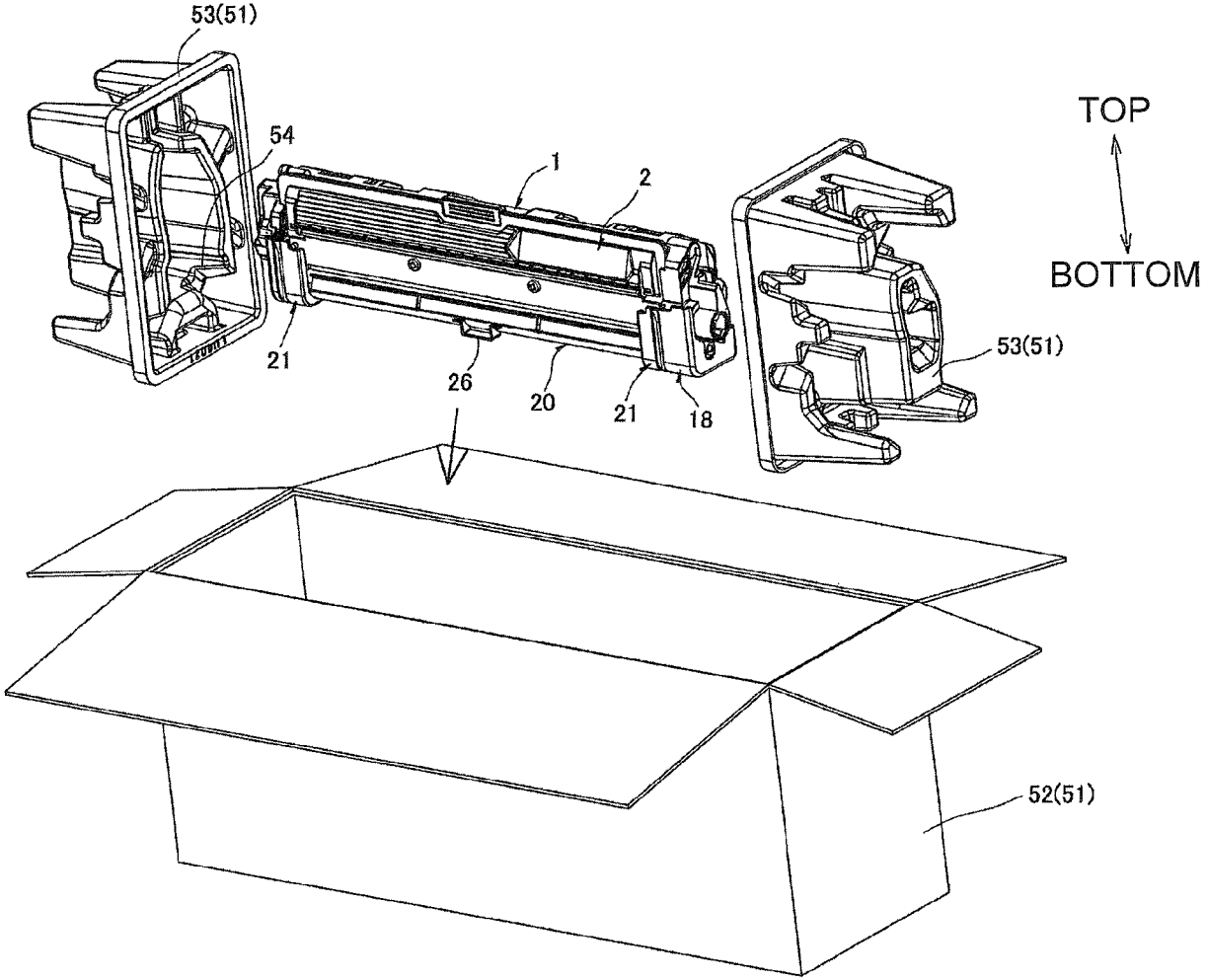
FIG. 6 illustrates how the developer cartridge shown in FIG. 2 is packaged.

In case of transportation, e.g., shipment, as shown in FIG. 2, the rear end portion of the developer cartridge 1 (on a side where the opening 7 is released) is covered with a blade pressing member 18 as an example of a second blade pressing member. Then, as shown in FIG. 6, the developer cartridge 1 covered with the blade pressing member 18 is packaged in a packing member 51.

Figure 3:
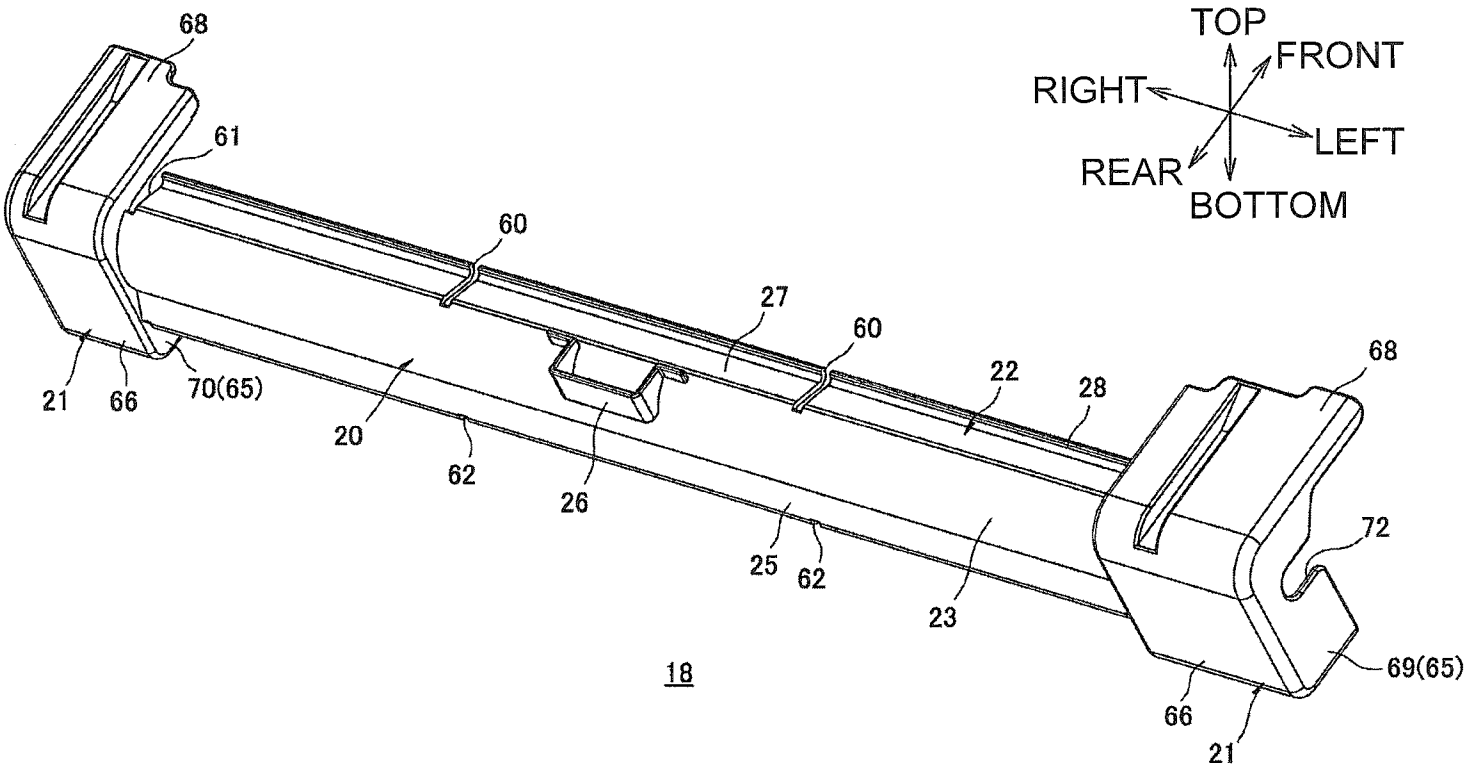
FIG. 3 is a perspective view of a blade pressing member shown in FIG. 2.
Figure 4:
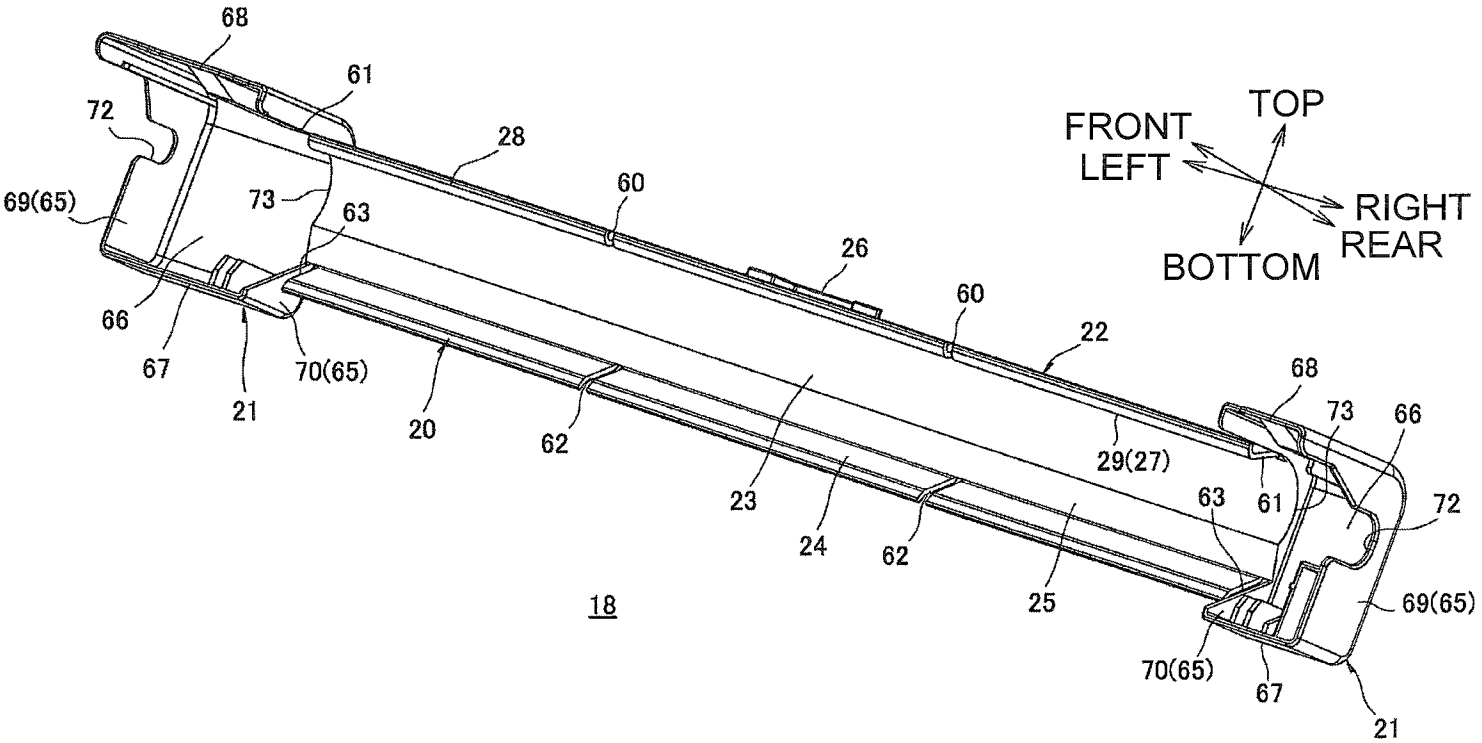
FIG. 4 is a perspective view of the blade pressing member shown in FIG. 2.

As shown in FIGS. 3 and 4, the blade pressing member 18 is made from a high molecular material, e.g., resin such as polypropylene, and integrally includes a body portion 20 extending in the left-right direction and gear covering portions 21 disposed on left and right end portions of the body portion 20.

As shown in FIG. 5A, the body portion 20 is shaped like a square bracket opening frontward in cross sectional view, and includes a pressing portion 22, a cover portion 23, a flat plate 25, and a pressing force receiving portion 24, which are continuously formed.

The cover portion 23 is shaped like an arc bulging rearward in cross sectional view, and includes a grasping portion 26 on the rear surface of the cover portion 23 as shown in FIG. 3.

The grasping portion 26 is open upward, and has substantially an angular U-shape in a plan view. The grasping portion 26 is integrally fixed to the rear surface of the cover portion 23 in a central portion thereof in the left-right direction.

As shown in FIG. 5A, the pressing portion 22 is substantially L-shaped in the cross sectional view. The pressing portion 22 includes an elastic portion 27 and a flange portion 28.

The elastic portion 27 continues from an upper end portion of the cover portion 23, and is shaped like a flat plate extending to a lower front side. The flange portion 28 is shaped like a flat plate extending from a front end portion of the elastic portion 27 to an upper front side.

As shown in FIG. 3, the elastic portion 27 and the flange portion 28 are elongated in the left-right direction.

As shown in FIG. 4, a lower surface of a front end portion of the elastic portion 27 includes a contact portion 29. The contact portion 29 extends in the left-right direction at the front end portion of the elastic portion 27.

As shown in FIG. 3, the pressing portion 22 has a first cut portion, e.g., upper slits 60, and upper notch portions 61.

The pressing portion 22 has two upper slits 60 spaced apart from each other such that the pressing portion 22 is divided into three portions in the left-right direction. Each of the upper slits 60 is cut from the front end portion of the flange portion 28 to the rear end portion of the elastic portion 27.

The pressing portion 22 includes two upper notch portions 61, which are formed one at the left end of the pressing portion 22 and one at the right end of the pressing portion 22. Each of the upper notch portions 61 is cut from the front end portion of the flange portion 28 to the rear end portion of the elastic portion 27. As the left and right end portions of the elastic portion 27 of the pressing portion 22 are not connected to inside sidewalls 70 of the gear covering portions 21, the elastic portion 27 is elastically deformable.

As shown in FIG. 5A, the flat portion 25 continues from the lower end portion of the cover portion 23, and is shaped like a flat plate extending downward.

The pressing force receiving portion 24 continues from the lower end portion of the flat portion 25 and is shaped like a flat plate extending frontward. The front end portion of the pressing force receiving portion 24 is bent to a lower front side.

As shown in FIG. 4, the flat portion 25 and the pressing force receiving portion 24 are elongated in the left-right direction.

The pressing force receiving portion 24 has a second cut portion, e.g., lower slits 62, and lower notch portions 63.

The pressing force receiving portion 24 has two lower slits 62 spaced apart from each other such that the pressing force receiving portion 24 is divided into three portions in the left-right direction. Each of the lower slits 62 is cut from a front end portion of the pressing force receiving portion 24 to a rear end portion thereof. The lower slits 62 are located opposite to the upper slits 60 vertically.

The pressing force receiving portion 24 has two lower notch portions 63 formed at the left and right ends of the pressing force receiving portion 24, respectively. Each of the lower notch portions 63 is cut from the front end portion of the pressing force receiving portion 24 to the rear end portion thereof. The lower notch portions 63 are located opposite to the upper notch portions 61 vertically. A distance between the upper slit 60 and the upper notch portion 61 is substantially equal or equal to a distance between the lower slit 62 and the lower notch portion 63.

As the left and right end portions of the pressing force receiving portion 24 are not connected to the inside sidewalls 70 of the gear covering portions 21, the pressing force receiving portion 24 is elastically deformable.

Each of the gear covering portions 21 is shaped like a box opening frontward, and includes a pair of left and right sidewalls 65, a rear wall 66, a lower wall 67, and an upper wall 68.

The sidewalls 65 are shaped like a rectangle in a side view, and are spaced apart from and facing each other in the left-right direction.

More specifically, the sidewalls 65 are an outside sidewall 69 disposed outside in the left-right direction and an inside sidewall 70 disposed inside in the left-right direction.

The outside sidewall 69 of each gear covering portion 21 has a developing shaft collar exposure recess 72 in a central portion vertically.

The developing shaft collar exposure recess 72 is substantially U-shaped, and recessed rearward from the front end portion of the outside side wall 69.

The inside sidewall 70 of each gear covering portion 21 has a communication groove 73.

The communication groove 73 is recessed rearward from the front end portion of each inside sidewall 70 such as to correspond to each of the left and right end portions of the body portion 20.

As shown in FIGS. 3 and 4, the rear wall 66 is shaped like a rectangle in a front view, extending between rear end portions of the sidewalls 65.

The lower wall 67 is shaped like a rectangle in a plan view, extending between lower end portions of the sidewalls 65 continuously to a lower end portion of the rear wall 66.

The upper wall 68 is shaped like a rectangle in a plan view, extending between upper end portions of the sidewalls 65 continuously to an upper end portion of the rear wall 66. A length of the upper wall 68 is longer than a length of the lower wall 67 in the front-rear direction.

The body portion 20 and the gear covering portions 21 are integrally formed by connecting left and right end portions of the cover portion 23 and the flat portion 25 with peripheral end portions of the communication grooves 73 of the inside sidewalls 70. Thus, the body portion 20 and the gear covering portions 21 are connected via the communication grooves 73 in the left-right direction.

The following will describe how the blade pressing member 18 is attached to the developer cartridge 1.

When the blade pressing member 18 is attached to the developer cartridge 1, the grasping portion 26 of the blade pressing member 18 is held and the blade pressing member 18 is disposed at the rear of the developer cartridge 1 such that the developing shaft collar exposure recesses 72 correspond to the developing roller collars 14, as shown in FIGS. 2 and 5A.

Then, the blade pressing member 18 is moved toward the developer cartridge 1 until the front surface of the flat portion 25 contacts the rear end portion of a bottom wall of the developer frame 2.

Figure 5B:
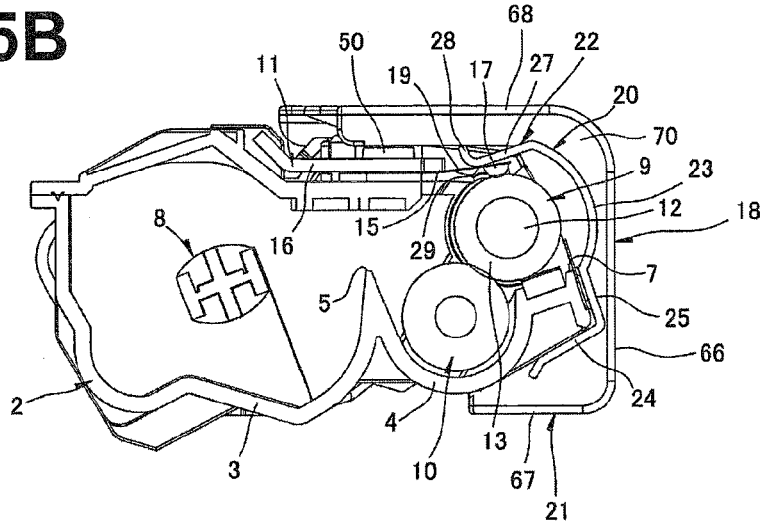

As shown in FIG. 5B, the pressing portion 22 and the pressing force receiving portion 24 are disposed to sandwich the rear end portion of the developer cartridge 1 (including the blade 15, the developing roller 9 and the bottom wall of the developer frame 2) therebetween. In other words, when the blade pressing member 18 is attached to the developer cartridge 1, the pressing force receiving portion 24 is disposed opposite to the pressing portion 22 with respect to the developing roller 9.

As shown in FIG. 2, the developing shaft collars 14 are located within corresponding developing shaft collar exposure recesses 72, and the developing gear 36 is covered with the left rear wall 66.

The upper walls 68 are disposed to cover the gear portion 38 of the drive unit 32 and the sector gear 45 of the power supply unit 33, respectively.

In this way, the blade pressing member 18 is completely attached to the developer cartridge 1.

In the blade pressing member 18 attached to the developer cartridge 1, the contact portion 29 of the pressing portion 22 is located further forward than the regulating portion 17 of the blade 15 and contacts the exposed portion 19 of the blade 15, pressing the exposed portion 19 toward the developing roller 9.

The cover portion 23 is located opposite to and spaced apart from the rubber roller 13 exposed from the opening 7 in the front-rear direction, and covers the rubber roller 13.

To remove the blade pressing member 18 from the developer cartridge 1, the attachment procedure described above is reversed. The blade pressing member 18 is detachably attached to the developer cartridge 1.

When the blade pressing member 18 is removed from the developer cartridge 1, the pressing portion 22 is disengaged from the blade 15, and the blade 15 slightly oscillates. Oscillation of the blade 15 causes toner interposed between the blade 15 and the rubber roller 13 to flow in the developing chamber 4. Thus, the possibility that the toner adheres between the blade 15 and the rubber roller 13 can be reduced.

The developer cartridge 1 to which the blade pressing member 18 is attached as described above is packaged with packaging material 51.

As shown in FIG. 6, the packaging material 51 includes a shipping carton 52 and two cushioning members 53.

The shipping carton 52 is formed of cardboard or corrugated cardboard, and shaped like a box elongated in the left-right direction.

The two cushioning members 53 are formed of cardboard or corrugated cardboard, and shaped like a rectangle elongated vertically in a side view. Each of the cushioning members 53 has a recessed portion 54 formed in its central portion vertically in such a manner as to receive the left or right end portion of the developer cartridge 1.

The two cushioning members 53 have vertical lengths substantially equal or equal to a vertical length of the shipping carton 52. The cushioning members 53 have horizontal lengths such that a horizontal length of the cushioning members 53 and the developer cartridge 1 received in the recessed portions 54 is substantially equal or equal to a horizontal length of the shipping carton 52.

To package the developer cartridge 1, the cushioning members 53 are attached to the left and right end portion of the developer cartridge 1 first.

To attach the cushioning members 53 to the developer cartridge 1, the rear end portion of the developer cartridge (a side where the blade pressing member 18 is attached) 1 is placed facedown, and the left and right end portions of the developer cartridge 1 are inserted into the recessed portions 54 of the cushioning members 53.

Thus, the cushioning members 53 are attached to the left and right end portions of the developer cartridge 1.

Then, an upper end portion of the shipping carton 52 is released, and the developer cartridge 1 with the cushioning members 52 attached is inserted into the shipping carton 52 from the rear end portion side to which the blade pressing member 18 is attached, first.

Then, the upper end portion of the shipping carton 52 is closed.

In this way, the developer cartridge 1 is completely packaged in the packaging material 51.

In the developer cartridge 1 to which the blade pressing member 18 is attached, as shown in FIG. 5B, the pressing portion 22 presses the exposed portion 19 of the blade 15 toward the developing roller 9. Thus, if the developer cartridge 1 accidentally drops, for example, during shipment, the blade pressing member 18 can reduce the possibility of a gap between the rubber roller 13 and the regulating portion 17 formed due to drop impacts. Thus, the blade pressing member 18 can reduce the possibility that toner leaks from between the rubber roller 13 and the regulating portion 17.

Thus, the blade pressing member 18 and the developer cartridge 1 with the blade pressing member 18 attached thereto can reduce the possibility of toner leakage during transportation, e.g., shipment.

As shown in FIG. 3, the blade pressing member 18 includes the cover portion 23.

When the blade pressing member 18 is attached to the developer cartridge 1, the cover portion 23 covers the rubber roller 13 exposed from the opening 7.

Thus, during shipment of the developer cartridge 1, for example, the blade pressing member 18 can prevent the rubber roller 13 of the developing roller 9 exposed from the opening 7 from being touched.

As a result, any damage to the rubber roller 13 of the developing roller 9 which may be caused during transportation of the developer cartridge 1 can be prevented.

The contact portion 29 of the pressing portion 22 presses the exposed portion 19 of the blade 15 at the further forward position than the contact portion between the regulating portion 17 and the rubber roller 13.

Thus, the deformation of the rubber roller 13 of the developing roller 9 can be prevented, and the size of the developer cartridge 1 can be reduced in the front-rear direction.

The pressing portion 22 includes the elastic portion 27 and the flange portion 28.

The flange portion 28 is disposed at the front end portion of the elastic portion 27 entirely in the left-right direction.

Thus, the strength of the elastic portion 27 can be improved, such that the elastic portion 27 can press the blade 15 with a constant pressing force.

As a result, the possibility of a gap formed between the rubber roller 13 and the regulating portion 17 can be reduced, and thus the possibility that toner leaks from between the rubber roller 13 and the regulating portion 17 can be reduced.

The pressing portion 22 has two upper slits 60 formed therein.

Each of the upper slits 60 extends rearward from the front end portion of the flange portion 28 to the rear end portion of the elastic portion 27.

For example, if the developer cartridge 1 to which the blade pressing member 18 is attached accidentally drops, the pressing portion 22 bends at the upper slits 60 following the developing roller 9 being deformed due to drop impacts.

As a result, even if the developer cartridge 1 accidentally drops, the pressing portion 22, which is bent following the developing roller 9, presses the exposed portion 19 of the blade 15 toward the developing roller 9. Thus, the possibility of a gap formed between the rubber roller 13 and the regulating portion 17 can be reduced.

The blade pressing member 18 includes the pressing force receiving portion 24.

When the blade pressing member 18 is attached to the developer cartridge 1, the pressing force receiving portion 24 is located opposite to the pressing force 22 with respect to the developing roller 9 such that the pressing force receiving portion 24 and the pressing portion 22 sandwich the rear end portion of the developer cartridge 1 (including the blade 15, the developing roller 9 and the bottom wall of the developer frame 2) therebetween.

Thus, the relative positional relationship between the blade pressing member 18 and the developer cartridge 1 can be kept constant and a pressing force of the pressing portion 22 can be applied to the blade 15 reliably.

As a result, the possibility that a gap may be formed between the rubber roller 13 and the regulating portion 17 can be reduced.

The pressing force receiving portion 24 includes two lower slits 62 formed therein.

Each of the lower slits 62 extends rearward from the front end portion of the pressing force receiving portion 24 to the rear end portion thereof.

For example, if the developer cartridge 1 to which the blade pressing member 18 is attached accidentally drops, the pressing force receiving portion 24 bends at the lower slits 62 so as to follow the developing roller 9 being deformed due to drop impacts.

As a result, even if the developer cartridge 1 accidentally drops, the relative positional relationship between the developing roller 9 and the pressing force receiving portion 24 of the blade pressing member 18 can be kept constant.

The pressing portion 22 includes the elastic portion 27, which is elastically deformable, and the contact portion 29. The contact portion 29 is formed as the lower surface of the front end portion of the elastic portion 27 and is provided at the front end portion of the elastic portion 17 entirely in the left-right direction.

Due to the elastic force of the elastic portion 27, the contact portion 29 presses the exposed portion 19 of the blade 15 uniformly toward the developing roller 9. Thus, the potential for formation of a gap between the regulating portion 17 and the rubber roller 13 can be reduced. As a result, the possibility that toner leaks from between the regulating portion 17 and the rubber roller 13 can be also reduced.

The pressing portion 22 includes the upper notch portions 61 at the left and right end portions thereof respectively.

Each of the upper notch portions 61 extends rearward from the front end portion of the flange portion 28 to the rear end portion of the pressing portion 22.

Due to a simple structure for providing the upper notch portions 61, the elastic portion 27 can be elastically deformable.

The blade pressing member 18 is made from a high molecular material, e.g., polypropylene.

Thus, in a case that the developer cartridge 1 to which the blade pressing member 18 is attached is transported, a pressing force of the pressing portion 22 does not act on the rubber roller 13 more than necessary. Thus, deformation of the rubber roller 13 such as an impression left thereon can be reduced.

A second embodiment will be described with reference to FIG. 7.

Figure 7:
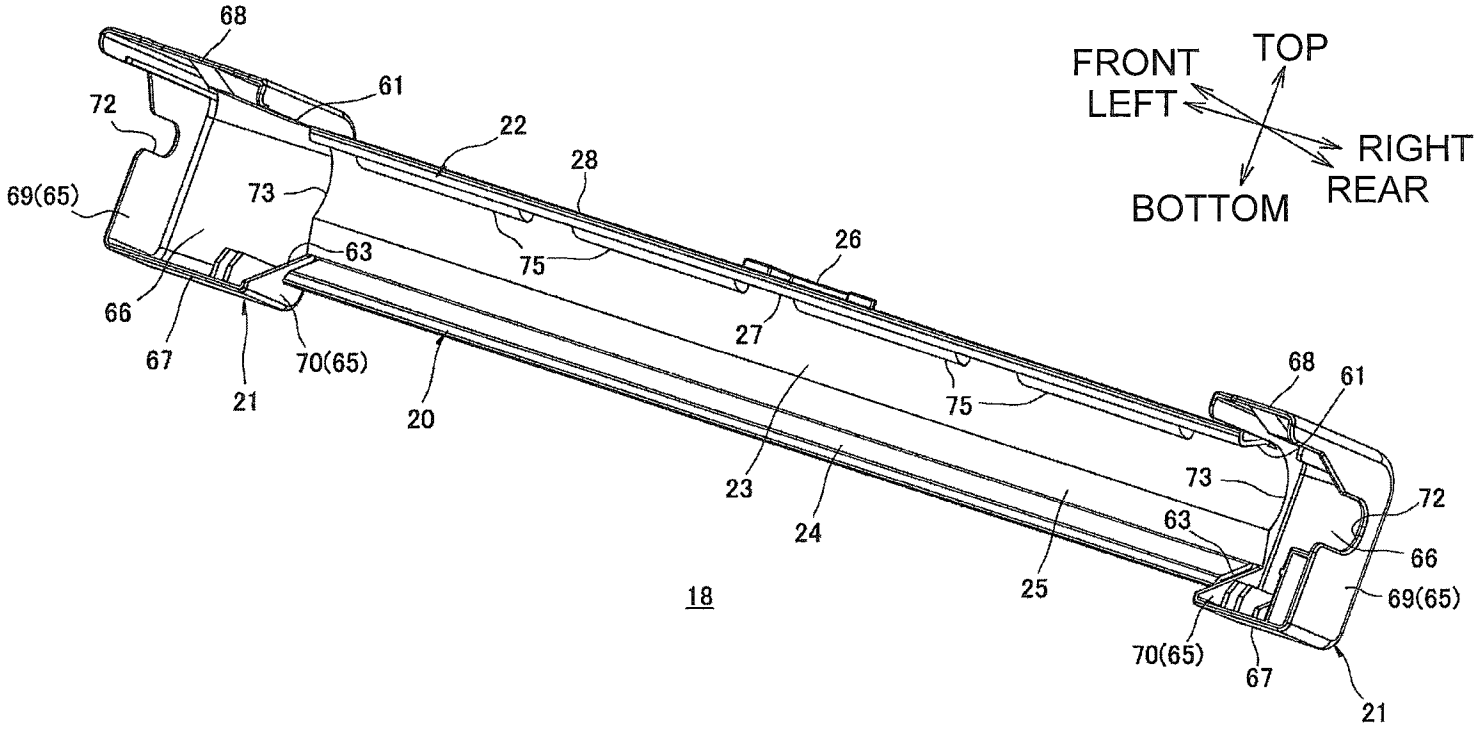
FIG. 7 is a perspective view of a blade pressing member according to a second illustrative embodiment of the developer cartridge of the disclosure.

In FIG. 7, those elements corresponding to the elements shown in FIGS. 1 to 6 are identified with the same numerals and their descriptions are omitted.

In the first embodiment, as shown in FIG. 4, the lower surface of the front end portion of the elastic portion 27 is formed as the contact portion 29. However, in the second embodiment, as shown in FIG. 7, a plurality of, e.g., four, contact portions 75 are formed on the lower surface of the front end portion of the elastic portion 27.

The four contact portions 75 are made from an elastic resin, e.g., silicone resin, and spaced apart from each other in line in the left-right direction.

Each of the contact portions 75 is shaped like an arc protruding downward from the lower surface of the elastic portion 27 in a side view.

In the second embodiment, when the blade pressing member 18 is attached to the developer cartridge 1, the contact portions 75 contact the exposed portion 19 of the blade 15, and press the exposed portion 19 toward the developing roller 9 in equilibrium due to the elastic force of the elastic portion 27.

Thus, the potential that a gap is formed between the regulating portion 17 and the rubber roller 13 can be reduced, and the possibility of toner leakage from between the regulating portion 17 and the rubber roller 13 can be reliably reduced.

It is noted that first embodiment and the second embodiment can be combined as necessary.

Although an illustrative embodiment and examples of modifications of the present disclosure have been described in detail herein, the scope of the disclosure is not limited thereto. It will be appreciated by those skilled in the art that various modifications may be made without departing from the scope of the disclosure. Accordingly, the embodiment and examples of modifications disclosed herein are merely illustrative. It is to be understood that the scope of the disclosure is not to be so limited thereby, but is to be determined by the claims which follow.

What is claimed is:

1. A developer cartridge comprising:

a casing configured to store developer therein;

a developing roller rotatably supported by the casing;

a blade having a first end portion and a second end portion opposite to the first end portion, the first end portion being supported by the casing, the blade being configured to regulate the developer carried on a peripheral surface of the developing roller to a predetermined thickness at the second end portion;

a first blade pressing member configured to press the first end portion of the blade; and a second blade pressing member configured to be attached to and removed from the casing, the second blade pressing member including a pressing portion configured to press the second end portion of the blade toward the developing roller.

2. The developer cartridge according to claim 1, wherein the second blade pressing member includes a cover portion configured to cover the developing roller exposed from an opening of the casing.

3. The developer cartridge according to claim 1, wherein the pressing portion of the second blade pressing member includes a flange portion extending in an axial direction of the developing roller.

4. The developer cartridge according to claim 1, wherein the pressing portion of the second blade pressing member has a first cut portion cut in a direction crossing an axial direction of the developing roller.

5. The developer cartridge according to claim 1, wherein the second blade pressing member further includes a pressing force receiving portion disposed opposite to the pressing portion with respect to the developing roller such that the pressing force receiving portion and the pressing portion sandwiches the casing therebetween.

6. The developer cartridge according to claim 5, wherein the pressing force receiving portion of the second blade pressing member has a second cut portion cut in a direction crossing an axial direction of the developing roller.

7. The developer cartridge according to claim 1, wherein the pressing portion of the second blade pressing member includes an elastic portion configured to elastically deform, and a plurality of contact portions configured to contact the blade, the contact portions being spaced apart from each other on the elastic portion in an axial direction of the developing roller.

8. The developer cartridge according to claim 7, wherein both end portions of the elastic portion in the axial direction are cut in the direction crossing the axial direction of the developing roller.

9. The developer cartridge according to claim 1, wherein the pressing portion of the second blade pressing member includes an elastic portion configured to elastically deform, and a contact portion configured to contact the blade, the contact portion being disposed along the elastic portion entirely in an axial direction of the developing roller.

10. The developer cartridge according to claim 9, wherein both end portions of the elastic portion in the axial direction are cut in a direction crossing the axial direction of the developing roller.

11. The developer cartridge according to claim 1, wherein the second blade pressing member is made from a high molecular material.

12. A blade pressing member configured to be attached to and removed from a developer cartridge, the developer cartridge including a casing, a developing roller, and a blade, the casing being configured to store developer therein, the developing roller being supported by the casing, the blade having a first end portion and a second end portion opposite to the first end portion, the first end portion being supported by the casing, the blade being configured to regulate the developer carried on a peripheral surface of the developing roller to a predetermined thickness at the second end portion, the blade pressing member comprising:

a pressing portion configured to press the second end portion of the blade toward the developing roller.

13. The blade pressing member according to claim 12, further comprising a cover portion configured to cover the developing roller when the blade pressing member is attached to the developer cartridge.

14. The blade pressing member according to claim 12, wherein the pressing portion includes a flange portion extending in an axial direction of the developing roller.

15. The blade pressing member according to claim 12, wherein the pressing portion has a first cut portion cut in a direction crossing an axial direction of the developing roller.

16. The blade pressing member according to claim 12, further comprising a pressing force receiving portion disposed opposite to the pressing portion with respect to the developing roller, wherein the pressing portion and the pressing force receiving portion are disposed to sandwich the developer cartridge therebetween.

17. The blade pressing member according to claim 16, wherein the pressing force receiving portion has a second cut portion cut in a direction crossing an axial direction of the developing roller.

18. The blade pressing member according to claim 12, wherein the pressing portion includes an elastic portion configured to elastically deform, and a plurality of contact portions configured to contact the blade, the contact portions being spaced apart from each other on the elastic portion in an axial direction of the developing roller.

19. The blade pressing member according to claim 12, wherein the pressing portion includes an elastic portion configured to elastically deform, and a contact portion configured to contact the blade, the contact portion being disposed along the elastic portion entirely in an axial direction of the developing roller.

* * * * *